United States Patent [19]

Shaw

[11] 3,934,856

[45] Jan. 27, 1976

[54] MINE HOISTS

[75] Inventor: Bernard Elliott Shaw, Paisley, Scotland

[73] Assignee: Fullerton, Hodgart & Barclay Ltd., Paisley, Scotland

[22] Filed: June 14, 1974

[21] Appl. No.: 479,505

[30] Foreign Application Priority Data

June 14, 1973 United Kingdom ..... 28418/73

[52] U.S. Cl. ..... 254/184; 254/173 R

[51] Int. Cl.[2] ..... B66D 1/26

[58] Field of Search ..... 254/173, 183, 184, 150; 187/28, 29; 73/158, 510; 318/272, 369

[56] References Cited

UNITED STATES PATENTS

| | | | |
|---|---|---|---|
| 2,823,897 | 2/1958 | Kellogg | 254/184 |
| 3,158,356 | 11/1964 | Carlson et al. | 254/173 R |
| 3,497,787 | 2/1970 | Fuelster et al | 254/173 R |
| 3,596,070 | 7/1971 | McCool et al. | 254/173 R |
| 3,759,489 | 9/1973 | Jones | 254/173 R |
| 3,780,990 | 12/1973 | Edlund et al. | 254/173 R |
| 3,819,156 | 6/1974 | Sleracki | 254/173 R |

*Primary Examiner*—Robert J. Spar
*Assistant Examiner*—Kenneth Noland
*Attorney, Agent, or Firm*—Larson, Taylor & Hinds

[57] ABSTRACT

A mine winder has two cable drums and a braking mechanism for each. Each braking mechanism includes means operable to sense if the cable is moving and in which direction and the length of cable paid out and to issue a control signal containing this information. Brake control means is operable on receipt of the control signal to operate braking means and apply to the drum a braking effort based on the information in the control signal. A cable movement detector sensitive to the speed of movement of the cable may be provided to be operative to send a corresponding control signal to the brake control means. The braking means may be air-pressure operated, the brake control means adjusting the air pressure according to the control signal received.

7 Claims, 1 Drawing Figure

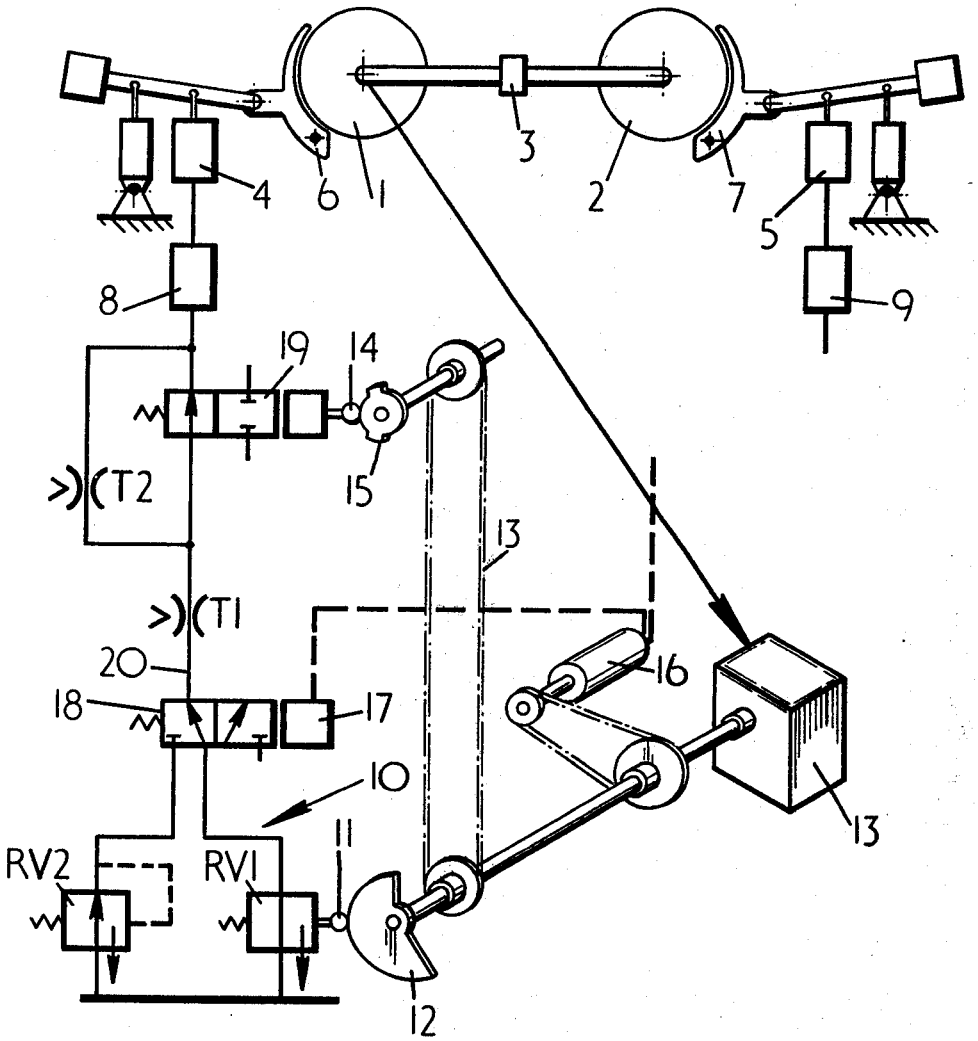
1
2
3
4
5
6
7
8
9
10
11
12
13
13
14
15
16
17
18
19
20
T1
T2
RV1
RV2

MINE HOISTS

Generally in accordance with the invention, a mine winder of the type having two load-carrying cables wound in opposite directions around respective drums incorporates for each cable and its associated cable-supporting drum a braking mechanism, the braking mechanism comprising motion-sensitive means for sensing the immediate operating conditions of the cable, the motion-sensitive means incorporating one element the position of which is variable according to the amount of cable paid out from the drum and a second element arranged to occupy one of two possible extreme positions, one of which corresponds with most of the cable paid out or most of the cable reeled in and the other of which corresponds with positions of the cable between these extreme positions, the positions of these two elements consituting mechanical signals, and a cable movement detector arranged to sense whether the cable is moving above or below a predetermined minimum speed and if it is moving above this minimum speed in which direction and to generate a corresponding signal, pressure operated braking means for controlling the rate of movement of the cable, brake control means including air pressure control means operative to provide at least two separate supplies of air at different pressures and means for varying the pressure of the supply at the higher pressure between a minimum and a maximum value, this last mentioned means being arranged to receive a signal from said one element and to act according to the signal received to vary the air supply pressure, a changeover valve connected to the air pressure control means and having operating means arranged to receive a signal from the cable movement detector and thereupon connect an output from the valve to either of said supplies of air according to the signal received, two air flow restricting devices connected between the outlet of the changeover valve and the braking means and arranged to provide individually different time delays in the build-up of pressure across the devices, and a time delay selecting device having operating means arranged to receive a signal from the said second element and to act according to the signal received to render effective the appropriate air flow restricting device.

Preferably the brake control means is so arranged that when it receives a control signal from the cable movement detector indicating that the cable is not moving or is moving at less than the predetermined minimum speed the operating means of the changeover valve operates to bring into use the supply of air at the higher pressure irrespective of the position of the load thus causing the braking means to apply full braking effort.

The brake control means may be arranged to respond to the signal indicating that most of the cable is paid out or reeled in by setting the braking means to operate rapidly whether with high or low braking effort and when the signal indicates that the cable is in an intermediate position to respond by setting the braking means to apply the braking effort at a less rapid rate whether high or low effort is being applied in conformity with the prevailing conditions.

The motion-sensitive means may include several different devices each sensitive to a particular condition. For example, said means may include a cam in operative connection with the cable so that the position of the cam is dependent on the amount of cable paid out i.e. the position of the load, and a cam follower engaged with the cam and operatively connected to means for adjusting the pressure of the air supply at the higher pressure and a separate cable movement detector capable of detecting whether or not the cable is moving at a speed above or below a predetermined minimum speed and the direction of any such movement and a delay selecting device incorporating a cam in operative connection with the cable and a cam follower having two extreme positions, one corresponding with the positions of the load near either end of its travel and the other corresponding with all intermediate positions of the load.

The cable movement detector may incorporate a rotatable element operatively coupled to the cable so as to be rotatable in conformity with the cable movement and carrying at least one magnet in magnetic proximity to an armature operatively coupled to signal-generating means operable to generate a signal containing information relating to the speed and direction of movement of the cable. The rotatable element may be geared to the cable drum or may be geared to a pulley with which the cable is in driving contact.

The cam may be geared to the cable drum or may be geared to a pulley with which the cable is in contact in which case the cam and the cable movement detector may be geared to the same pulley.

The brake control means may include two pressure-reducing valves connectible in parallel to a supply of air under pressure, one of the reducing valves being set to reduce the pressure of the supply to a predetermined low pressure, for example about 10% of the supply pressure, and the other pressure-reducing valve being arranged to have a variable setting providing a range of pressure from a minimum high pressure to a maximum high pressure and constituting the means for adjusting the high braking effort, the pressure-setting control means of the variable-pressure reducing valve being coupled to the cam follower in such wise that when the cam is in the position corresponding with the maximum amount of cable paid out, i.e. when the load is approaching the bottom, the valve is caused to be set for maximum pressure and at all other positions the valve is set at a pressure lying between the minimum high pressure and the maximum high pressure, the changeover valve being connected to the outputs of the two pressure-reducing valves and being operable to connect the outputs alternatively to a single output, from the changeover valve; control means for the changeover valve connected to the cable movement detector and operable so that when said device indicates that hoisting is in progress the control means operates to connect the low pressure reducing valve to the output of the changeover valve and when the cable is being paid out the control means operates to connect the high pressure reducing valve to the output of the changeover valve; a short delay restricting orifice and a long delay restricting orifice constituting air flow restricting devices, connected in series between the output of the changeover valve and the braking means; a by-pass valve constituting the delay-selecting device connected in parallel with the long delay orifice and control means for the by-pass valve operably connected to the cable movement detector so that when the cable movement detector signals that the load is between the ends of its travel the by-pass valve control means operates to close the by-pass valve and when the cable movement detector signals that the load is approaching the top or the bottom the by-pass valve control means operates to open the by-pass valve.

The motion-sensitive means may also be so arranged that when the cable is at rest or is moving at a speed lower than the predetermined minimum speed the cable movement detector operates to set the changeover valve to connect the high pressure reducing valve to the input of the changeover valve.

A practical embodiment of the invention is illustrated in the accompanying drawing which illustrates two cable drums connectible to one another but only one braking mechanism associated with one drum since the braking mechanism associated with the other drum is identical. In the drawing 1 and 2 denote brake drums connectible to one another by a disconnectible coupling 3, 4 and 5 denote brake operating cylinders for the brakes 6 and 7 associated with the drums 1 and 2 respectively, and 8 and 9 denote control valves for the cylinders 4 and 5. 10 denotes motion-sensitive means incorporating one element constituted by a cam follower 11 engaging a cam 12 geared to the drum 1 by a gear connection 13 so that the position of the cam follower 11 is varied according to the amount of cable paid out from the drum, and a second element constituted by a second cam follower 14 engaging a cam 15 also geared to the drum 1 by means of the gear connection 13, the cam 15 being so contoured that the follower 14 occupies one of two possible extreme positions, one of which corresponds with most of the cable paid out or most of the cable reeled in and the other of which corresponds with positions of the cable between these extreme positions, the position of these two elements 11 and 14 constituting mechanical signals, and a cable movement detector 16 also geared to the drum 1 by the gear connection 13 and arranged to sense whether the cable is moving above or below a predetermined minimum speed and if it is moving above said minimum speed in which direction and to generate a corresponding signal which in the illustrated embodiment is an electrical signal and which is applied to a solenoid 17 controlling operation of a changeover valve 18. The cam follower 14 is operatively connected to a valve 19 controlling the delay selecting device.

The air pressure control means includes two pressure-reducing valves RV1 and RV2 connected in parallel to a supply of air under pressure, one of the valves RV2 being set to reduce the pressure of the supply to a predetermined low pressure, for example about 10% of the supply pressure, and the valve RV1 being arranged to have a variable setting providing a range of pressure from a minimum high pressure to a maximum high pressure and constituting the means for adjusting the high braking effort, the pressure-setting control means of the valve RV1 being coupled to the cam follower 11 in such wise that when the cam 12 is in the position corresponding with the maximum amount of cable paid out, i.e. when the load is approaching the bottom, the valve RV1 is caused to be set for maximum pressure and at all other positions the valve is set at a pressure lying between the minimum high pressure and the maximum high pressure. The changeover valve 18 is connected to the outputs of the two pressure-reducing valves RV1 and RV2 and is operable according to the signal it receives from the cable movement detector 16 to connect the said outputs alternatively to a single line 20 containing a short delay restricting orifice T1. The output of the orifice T1 is connected to two branch lines each of which goes to the brake operating cylinder 4, one by way of the valve 19 and the other by way of a long delay restricting orifice T2.

In practice, when the cable is hoisting the load and if the speed of the cable is above the predetermined minimum speed the cable movement detector 16 operates to cause the changeover valve 18 to operate to bring into operation the low pressure reducing valve RV2 preferably set to an output pressure providing about 10% of the effort of which the brake is capable. This gives a braking rate of about $g/3$ reducing to $g/6$ as the load approaches the top and the retarding effort provided by the cable reduces. At the same time the delay selecting device constituted by the cam follower 14 and the cam 15 is operative to hold the valve 19 closed while the load is some distance from the top so that if air is admitted to the braking mechanism by opening of the valve 8 to apply the brakes the air flowing to the brake operating cylinder 4 must pass through the long delay restricting orifice T2 so that the rate of brake application is low and when the load comes close to the top to cause the valve 19 to open thus by-passing the long delay restricting orifice T2 and admitting air to the braking means directly through the short delay restricting orifice T1 so that a high application rate of the brakes takes place although at reduced effort. When the load is being lowered at a speed above the predetermined operating speed the device 16 sensitive to the direction of cable movement causes the changeover valve 18 to connect the high pressure reducing valve RV1 to the outlet of the changeover valve 18 while the cam 12 sets the high pressure reducing valve RV1 according to the position of the load, the setting ranging progressively from approximately half the maximum pressure available in the high pressure range when the load is at the top to the full pressure when the load is nearing the bottom. The full pressure provides a retardation of about $g/6$. At the same time the delay selecting device constituted by the valve 19 is set so that the valve 19 is closed when the load is away from the bottom but is open when the load comes close to the bottom. This provides a low application rate of the brakes when the load is some distance from the bottom and a high application rate when the load comes close to the bottom. If the cable should come to rest at any point the cable movement detector 16 operates to set the changeover valve 18 to connect the high pressure pressure reducing valve RV1 to the outlet of the changeover valve 18 irrespective of the position of the load and similarly if the cable is moving below the predetermined minimum speed the cable movement detector 16 operates in the same fashion to set the changeover valve 18 to connect the high pressure pressure reducing valve RV1 to its outlet. Safety means normally fitted to mine installations to initiate brake application in certain emergency situations may be arranged to control the supply of air to the brake control apparatus, the mechanism just described arranging the conditions of brake application according to the position of the load. The effect provided by the invention is thus to avoid the imposition of shock or undue stress on any part of the hoisting system with minimum discomfort to any occupants of the load where the load is a cage for personnel.

The apparatus of the invention is particularly effective in preventing bouncing of the cage. Such bouncing movement can be violent with too rapid application of the brakes in certain positions when the cage is suspended from the drum by a long length of cable. In such circumstances a too violent brake application results in a tension wave of high intensity being transmitted along the cable from the drum to the cage.

Where each cable is wound on a separate drum and the drums are coupled to one another the braking action described operates simultaneously and according to the conditions prevailing at each cable and provides a well-balanced effect between the two loads, one ascending and the other descending.

The operation of the braking system of the invention may be summarized by stating that the braking effort available on a drum which is lowering is varied substantially uniformly from the top of the shaft to the bottom in proportion to the amount of rope which is paid out so that the maximum braking effort available will produce substantially uniform retardation at all points in the shaft. When hoisting the braking effort is reduced to a figure which brings the brakes into contact with the drum at a minimum effort during the period while the load is in motion above creep speed. At creep speeds and when stopped the restriction is removed so that there is ample braking effort available to prevent the load from slipping down once it has come to rest.

It will be understood that speed of application of the brake is independent of the force with which the brake is applied i.e. a rapid application may take place with low braking effort or a slow brake application may take place with high braking effort.

The accompanying table will help to clarify the operating conditions provided by the invention.

| Condition of cable movement | Position of load | Braking Effort | Braking pressure and rate of application |
|---|---|---|---|
| Hoisting | all positions | small fraction of the total effort (about 10%) (gives g/3 at maximum depth reducing to g/6 at top.) | low pressure supply to brakes, high application rate load approaching top, low application rate load elsewhere. |
| Lowering | all positions | about ½ maximum available at surface increasing to maximum near bottom (gives g/6 at maximum depth) | high pressure range about half pressure at surface rising to full pressure near bottom, low application rate except load approaching bottom. High application rate approaching bottom. |
| Stopped | anywhere | maximum braking power | high pressure |
| Moving at low speed, any direction | near top and near bottom | High braking power | high pressure high application rate |
| | intermediate positions | high braking power | high pressure low application rate |

What is claimed is:

1. In a mine winder of the type having two load-carrying cables wound in opposite directions around respective drums incorporating for each cable and its associated cable-supporting drum a braking mechanism, said braking mechanism comprising motion-sensitive means for sensing the immediate operating conditions of the cable, said motion-sensitive means incorporating one element the position of which is variable according to the amount of cable paid out from the drum and a second element arranged to occupy one of two possible extreme positions, one of which corresponds with most of the cable paid out or most of the cable reeled in and the other of which corresponds with positions of the cable between these extreme positions, the positions of these two elements constituting mechanical signals, and a cable movement detector arranged to sense whether the cable is moving above or below a predetermined minimum speed and if it is moving above said minimum speed in which direction and to generate a corresponding signal, pressure operated braking means for controlling the rate of movement of the cable, brake control means including air pressure control means operative to provide at least two separate supplies of air at different pressures and means for varying the pressure of the supply at the higher pressure between a minimum and a maximum value, said last mentioned means being arranged to receive a signal from said one element and to act according to the signal received to vary the air supply pressure, a changeover valve connected to the air pressure control means and having operating means arranged to receive a signal from the cable movement detector and thereupon connect an output from the valve to either of said supplies of air according to the signal received, two air flow restricting devices connected between the outlet of the changeover valve and the braking means and arranged to provide individually different time delays in the build-up of pressure across the devices, and a time delay selecting device having operating means arranged to receive a signal from said second element and to act according to the signal received to render effective the appropriate air flow restricting device.

2. A mine winder as claimed in claim 1 in which the cable movement detector is operative when it detects that the cable is not moving or is moving at less than the predetermined minimum speed to operate the changeover valve to bring into use the supply of air at the higher pressure.

3. A mine winder as claimed in claim 1 including a cam in operative connection with the cable, the position of the cam being dependent on the amount of cable paid out i.e. the position of the load, and a cam follower engaged with the cam, means for adjusting the pressure of the air supply at the higher pressure operatively connected to said cam, a separate cable movement detector capable of detecting whether or not the cable is moving at a speed above or below a predetermined minimum speed and the direction of any such movement, and a delay selecting device incorporating a cam in operative connection with the cable and a cam follower having two extreme positions, one corresponding with the positions of the load near either end of its travel and the other corresponding with all intermediate positions of the load, the cam follower being operative to bring one or other of said air flow restricting devices into operation according to its position.

4. A mine winder as claimed in claim 3 in which two pressure-reducing valves are connected in parallel to a supply of air under pressure, one of the reducing valves being set to reduce the pressure of the supply to a predetermined low pressure, and the other pressure-reducing valve being arranged to have a variable setting providing a range of pressure from a minimum high pressure to a maximum high pressure and constituting the means for adjusting the pressure of the air supply at the higher pressure, said variable-pressure reducing valve being so coupled to its associated cam follower that when the cam is in the position corresponding with the maximum amount of cable paid out, i.e. when the load is approaching the bottom, the valve is caused to be set for maximum pressure and at all other positions the valve is set at a pressure lying between the minimum high pressure and the maximum high pressure.

5. A mine winder as claimed in claim 4 in which the changeover valve is connected to the outputs of the two pressure-reducing valves and is operable to connect the outputs alternatively to a single output from the changeover valve.

6. A mine winder as claimed in claim 5 in which the changeover valve is operatively connected to the cable movement detector to operate so that when said detector indicates that hoisting is in progress the control means operates to connect the low pressure reducing valve to the output of the changeover valve and when the cable is being paid out the control means operates to connect the high pressure reducing valve to the output of the changeover valve; a short delay restricting orifice and a long delay restricting orifice constituting air flow restricting devices connected in series between the output of the changeover valve and the braking means; a by-pass valve constituting the delay-selecting device connected in parallel with the long delay orifice, and control means for the by-pass valve operably connected to the cable movement detector so that when the cable movement detector signals that the load is between the ends of its travel the by-pass valve control means operates to close the by-pass valve and when the cable movement detector signals that the load is approaching the top or the bottom the by-pass valve control means operates to open the by-pass valve.

7. A mine winder as claimed in claim 6 in which the cable movement detector is set so that when the cable is at rest or is moving at a speed lower than the predetermined minimum speed it operates to cause the changeover valve to connect the high pressure reducing valve to the input of the changeover valve.

* * * * *